US009943949B2

(12) United States Patent
Greding et al.

(10) Patent No.: US 9,943,949 B2
(45) Date of Patent: Apr. 17, 2018

(54) COUPLING PARTS FOR CONNECTING A DRIVING DEVICE TO AN EXPANDER HEAD

(75) Inventors: Arnd Greding, Hofheim (DE); Knut Lindner, Kelkheim (DE); Thoralf Krause, Leipzig (DE)

(73) Assignee: ROTHENBERGER AG, Kelkheim (DE)

( * ) Notice: Subject to any disclaimer, the term of this patent is extended or adjusted under 35 U.S.C. 154(b) by 500 days.

(21) Appl. No.: 13/818,371

(22) PCT Filed: Aug. 23, 2011

(86) PCT No.: PCT/DE2011/075199

§ 371 (c)(1),
(2), (4) Date: Feb. 22, 2013

(87) PCT Pub. No.: WO2012/037935

PCT Pub. Date: Mar. 29, 2012

(65) Prior Publication Data

US 2013/0156496 A1 Jun. 20, 2013

(30) Foreign Application Priority Data

Aug. 24, 2010 (DE) ..... 10 2010 035 221
Aug. 24, 2010 (DE) ..... 10 2010 035 222

(51) Int. Cl.
*B25B 27/10* (2006.01)
*B21D 41/02* (2006.01)

(52) U.S. Cl.
CPC ..... *B25B 27/10* (2013.01); *B21D 41/02* (2013.01); *Y10T 403/68* (2015.01); *Y10T 403/7005* (2015.01)

(58) Field of Classification Search
CPC ..... B21D 41/02–41/028; B21D 39/20; F16B 21/02; F16B 21/04; B25B 9/04; B25B 7/12; B25B 27/10

(Continued)

(56) References Cited

U.S. PATENT DOCUMENTS 2,219,907 A 10/1940 Ross
3,489,436 A * 1/1970 Ahlstone ..... E21B 33/043 285/123.2

(Continued)

FOREIGN PATENT DOCUMENTS

DE 2654102 A1 6/1978
DE 8807784 U 8/1988

(Continued)

OTHER PUBLICATIONS

Fachkunde Metall, Europa Lehrmittel, 55 Auflage , Dec. 2007, pp. 400-404.

(Continued)

*Primary Examiner* — Teresa M Ekiert

(57) ABSTRACT

A coupling for connecting a driving device to an expander head configured to expand pipes and hoses and to be actuated via an expanding mandrel driven by the driving device includes a first coupling part associated with the driving device and a second coupling part associated with the expander head. The first coupling part includes a through-hole that acts as a passage for the expanding mandrel and radially outwardly projecting circumferential portions disposed at a circumference, a rear face of the circumferential portions including at least one contact face. When connected, the coupling parts are disposed along an axis along which the expanding mandrel is movable for the actuation of the expander head. The second coupling part includes at least one counter-portion configured to act on a respective one of the at least one contact face of the circumferential portions.

12 Claims, 6 Drawing Sheets

(58) Field of Classification Search
USPC ..... 72/393, 370.01, 370.06–370.08, 481.3, 72/481.8; 403/328, 348–349
See application file for complete search history.

(56) References Cited

U.S. PATENT DOCUMENTS

| | | | | | |
|---|---|---|---|---|---|
| 4,154,083 | A | | 5/1979 | Rothenberger | |
| 4,668,119 | A | * | 5/1987 | Galletti | E02D 5/285 403/343 |
| 4,890,472 | A | * | 1/1990 | Rothenberger | 72/393 |
| 5,018,901 | A | * | 5/1991 | Ferree | B23Q 1/0063 403/316 |
| 5,243,845 | A | * | 9/1993 | Velte | 72/393 |
| 5,855,451 | A | * | 1/1999 | Milton et al. | 403/348 |

FOREIGN PATENT DOCUMENTS

| | | | | | |
|---|---|---|---|---|---|
| DE | 8907348 | U | | 7/1989 | |
| DE | 4104205 | C1 | | 10/1992 | |
| DE | 4202348 | C1 | | 6/1993 | |
| DE | 19830995 | A1 | | 1/1999 | |
| DE | 19730054 | C1 | | 3/1999 | |
| DE | 10247549 | B3 | | 5/2004 | |
| DE | 102007007294 | B3 | | 7/2008 | |
| EP | 1407838 | A2 | | 4/2004 | |
| GB | 580318 | A | * | 9/1946 | B21D 9/15 |
| GB | 2327247 | A | | 1/1999 | |

OTHER PUBLICATIONS

European Patent Office, International Search Report in International Patent Application No. PCT/DE2011/075199 (dated Mar. 6, 2011).

* cited by examiner

COUPLING PARTS FOR CONNECTING A DRIVING DEVICE TO AN EXPANDER HEAD

CROSS-REFERENCE TO RELATED APPLICATIONS

This application is a U.S. National Phase application under 35 U.S.C. § 371 of International Application No. PCT/DE2011/075199, filed on Aug. 23, 2011, and claims benefit to German Patent Application Nos. DE 10 2010 035 221.7, filed Aug. 24, 2010 and DE 10 2010 035 222.5, filed on Aug. 24, 2010. The International Application was published in German on Mar. 29, 2012 as WO 2012/037935 under PCT Article 21(2).

FIELD

The invention relates to a coupling for connecting a driving device to an expander head, which is used to expand pipes and hoses and which is actuated by means of an expanding mandrel driven by the driving device. The invention further relates to the coupling parts of a coupling of this type. The invention also relates to an expander head comprising a coupling part and to a driving device comprising a coupling part of a coupling of this type.

BACKGROUND

Expander heads, driving devices and couplings of the aforementioned type are conventionally part of an expander device, by means of which pipes and hoses are expanded. For this purpose, an expanding mandrel is moved in a translational manner in the direction of an axis, by means of the driving device, resulting in the expanding mandrel acting on the expander head. The expander head conventionally comprises expanding jaws, the outer faces of which press against and expand the inner circumference of the pipe or hose which is to be expanded. For this purpose, the contact force of the expanding jaws is conventionally brought about by the expanding mandrel, which acts on control faces of the expanding jaws during the axial movement of said mandrel, in such a way that the actuation force which is produced by the driving device is transferred via the axial movement of the expanding mandrel into a movement of the expander jaws in the radial direction.

As a result of the coupling of the expander device, the expander head and the driving device are held releasably against one another.

It is necessary in practice for the expander head to be releasable from the driving device in this manner, since the expander device is used to expand pipes and hoses of different materials, having different expansion properties and different diameters. For this purpose, whole arsenals of expander heads are conventionally provided on building sites or in manufacturing operations. It is thus necessary to change the expander heads frequently in practice.

One option for fixing the expander head to the driving device of the expander device is known from DE 10 2007 007 294 B3. In this case, the expander head and the driving device are interconnected by means of a screw coupling. For this purpose, the expander head comprises an internal thread, which can be screwed onto an external thread of the driving device for fixing to the driving device. Nowadays, screw couplings of this type are widespread in expander devices.

SUMMARY

In an embodiment, the present invention provides a coupling for connecting a driving device to an expander head configured to expand pipes and hoses and to be actuated via an expanding mandrel driven by the driving device. The coupling includes a first coupling part associated with the driving device and a second coupling part associated with the expander head. The first coupling part includes a through-hole that acts as a passage for the expanding mandrel and radially outwardly projecting circumferential portions disposed at a circumference, a rear face of the circumferential portions including at least one contact face. When connected, the coupling parts are disposed along an axis along which the expanding mandrel is movable for the actuation of the expander head. The second coupling part includes at least one counter-portion configured to act on a respective one of the at least one contact face of the circumferential portions.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
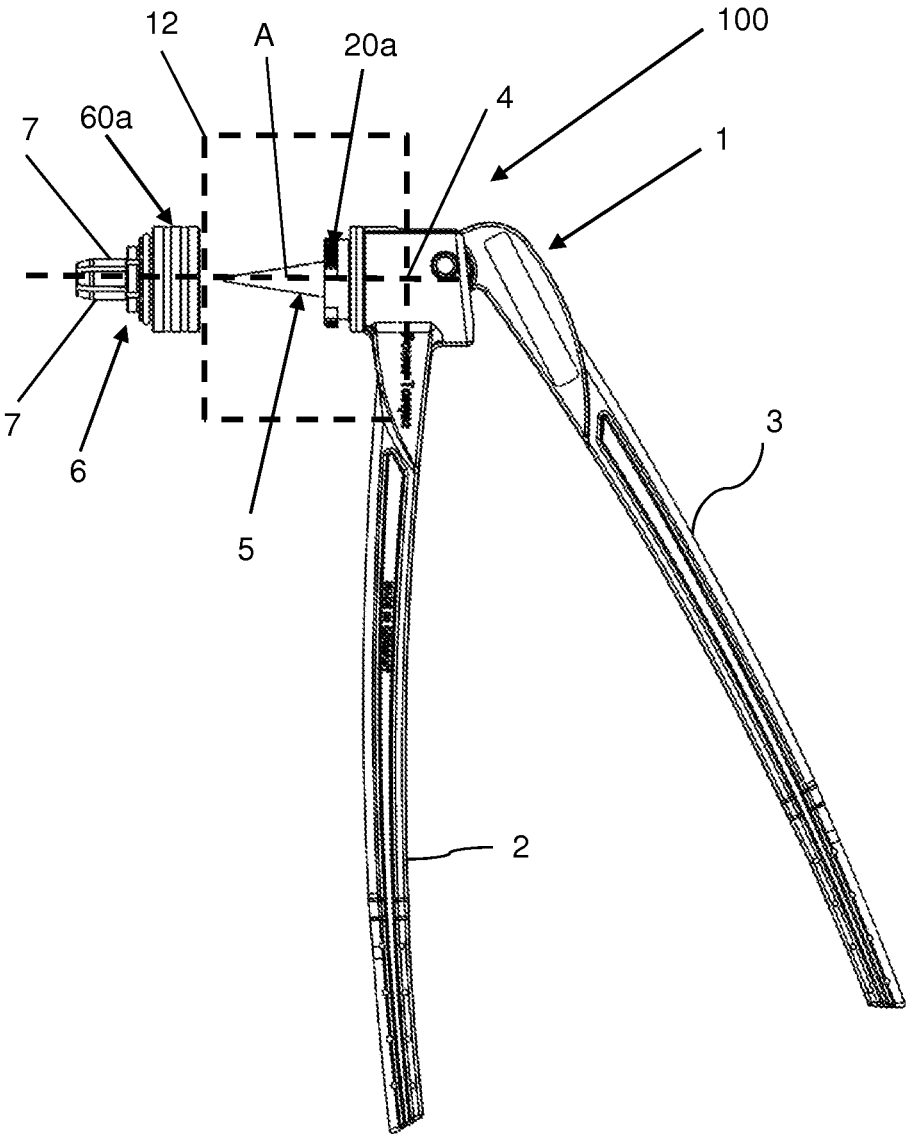
FIG. 1 is an exploded view of a possible embodiment of an expander device comprising an expander head and a driving device.

It has been found that assembling an expander head comprising a screw thread is relatively complex and time-consuming, since the expander head has to be positioned exactly on the driving device so as to achieve proper mutual engagement of the threads. Also, the expander head is only mounted correctly on the driving device once the expander head has been screwed onto the driving device in a plurality of rotations relative to the driving device. The frequent changes of expander heads, which are conventionally carried out during practical use of expander devices of this type, therefore lead to a relatively high overall idle time with heads of this type comprising a screw thread. Also, constantly screwing the expander head onto the driving device, which in each case involves carrying out multiple rotations of the expander head relative to the driving device, is relatively strenuous and tedious in the long run.

The invention, in an embodiment, provides an option which makes it possible to change the expander heads more rapidly and less strenuously. In accordance with an embodiment of the invention, it is also possible to use the expander heads comprising screw threads which have been commercially available thus far.

A coupling part according to an embodiment of the invention for a coupling for connecting a driving device to an expander head, which is used to expand pipes and hoses and which is actuated by means of an expanding mandrel driven by the driving device, is a first coupling part, which is or can be associated with the driving device and can be connected to a second coupling part, which is or can be associated with the expander head, the coupling parts, when assembled with one another, being arranged along an axis, in particular a shared axis, along which the expanding mandrel can be moved so as to actuate the expander head. For this purpose, the coupling part or first coupling part according to an embodiment of the invention comprises a through-hole, which extends in the direction of the axis and is used as a passage for the expanding mandrel.

According to an embodiment of the invention, the coupling part or first coupling part is provided on the circumference thereof with radially outwardly projecting circumferential portions, the rear face of which comprises at least one contact face for engaging with the second coupling part from behind.

As a result of this measure, a coupling for connecting a driving device to an expander head can be provided, by means of which the expander head can be exchanged for a different expander head rapidly and non-strenuously. In this way, fixing the expander head to the driving device by screwing, in a time-consuming and strenuous manner, is avoided.

Providing the radially outwardly projecting circumferential portions makes it possible to fix an expander head to the driving device in a simple manner by way of a positive fit, and this is achieved by engaging with the second coupling part from behind. For this purpose, the circumferential portions comprise, on the respective rear face thereof, the at least one contact face against which the second coupling part is supported so as to produce a positive fit connection which acts in the axial direction. In the context of the invention, the rear face should be understood to mean the face remote from the free end of the coupling part, whereas, in the context of the invention, the front face should be understood to mean the face of the first coupling part which faces the second coupling part.

It is conceivable for the circumferential portions to be formed in the manner of engagement hooks. The circumferential portions may also be sectors or segments, in particular circle sectors or circle segments.

The circumferential portions can be produced in a simple manner if the coupling part or first coupling part is formed by a hollow cylindrical base body, on the outer circumference of which the radially outwardly projecting circumferential portions are arranged, in particular integrally formed.

Preferably, the radial ends of the circumferential portions should lie on an outer circumference of which the contour substantially corresponds to the circumferential contour of the first coupling part. This measure also makes it possible to provide the coupling part or first coupling part by a simple method of production. This also results in a robust coupling part or first coupling part being formed, which is suitable for transferring relatively large axial forces.

In accordance with one embodiment of the invention, at least three circumferential portions are provided, and are distributed equidistantly on the circumference of the coupling part or first coupling part. As a result, by means of the coupling part or first coupling part, a coupling can be provided which also transfers very large actuation forces of the driving device in the axial direction, without a local material overload occurring.

In accordance with a preferred embodiment of the invention, a stop is provided, by means of which a coupling movement and/or uncoupling movement of the first coupling part relative to the second coupling part is delimited. As a result, handling is particularly facilitated for the user of the expander device when fixing the expander head to the driving device, since the at least one stop terminates a coupling movement when the second coupling part is brought into impact against the contact faces of the circumferential portions of the first coupling part.

In addition or as an alternative, handling is also facilitated when disassembling the expander head, since the stop terminates the decoupling movement when the second coupling part is brought out of contact with the contact faces of the circumferential portions of the first coupling part by moving relative to the first coupling part.

The stop may for example be formed in a particularly simple manner by a pin element, which is arranged at the end or start of a circumferential portion, as seen from the circumferential side, for example, and the longitudinal axis of which extends in the axial direction.

If the coupling movement is completed, for example by a rotational movement of the two coupling parts relative to one another, it can be provided, by means of a single stop, that during a movement counter to the coupling movement the two coupling parts are positioned decoupled from one another when one of the two coupling parts strikes against the stop.

In accordance with a further embodiment of the invention, it is provided that the circumferential portions are immovable relative to the first coupling part. For this purpose, the circumferential portions may be arranged immovably on a base body of the first coupling part, in particular formed integrally on the base body. As a result of the immovable circumferential portions, the circumferential portions remain permanently in an engagement position with respect to the second coupling part, in which the contact face of the circumferential portion is permanently aligned in the predetermined position for engaging with the second coupling part from behind. The first coupling part can be produced relatively simply as a result of the immovable circumferential portions thereof, since no mechanism has to be provided for moving the circumferential portions relative to the first coupling part.

In accordance with an alternative embodiment of the invention, it may be provided that the circumferential portions are held movably on the first coupling part, and can be moved out of an engagement position with respect to the second coupling part. As a result, the two coupling parts can be disassembled from one another in a simple manner, since for this purpose the circumferential portions merely have to be moved out of the engagement position, and the positive connection which is formed between the two coupling parts by the circumferential portions is thus released, in particular in the axial direction.

It is conceivable for the circumferential portions to be movable out of the engagement position with respect to the second coupling part, in that the circumferential portions are slid out of the engagement position, for example formed so as to be displaceable in the radial direction. It is also conceivable for the circumferential portions to be pivotable out of the engagement position.

The engagement position is preferably the position in which the circumferential portions project radially outwards, in such a way that the contact face, for engaging with the second coupling part from behind, of the rear face of the respective circumferential portions is fully released.

It is possible for the circumferential portions to be movable out of the engagement position with respect to the second coupling part against the restoring force of at least one spring element. As a result, it can be ensured that the circumferential portions are moved back into the engagement position automatically by the restoring force of the spring element when the actuation force for moving the circumferential portions out of the engagement position is removed.

Preferably, the circumferential portions should be held in the engagement position against the biasing force of the spring element. As a result, part of the force of the spring element is used as a biasing force, so as to hold the circumferential portions in the engagement position. As a result, any micro-movements of the circumferential portions, and resulting rattling noises, can be effectively prevented.

It is possible for the circumferential portions to be movable out of the engagement position with respect to the second coupling part with restricted guidance. As a result, a high degree of reliability is ensured when the two coupling parts are coupled to and uncoupled from one another, since the circumferential portions are guided in a predetermined movement path when they are moved out of the engagement position with respect to the second coupling part.

For example, in this way the circumferential portions can be moved with restricted guidance towards the axis against the restoring force of the spring element.

One possible embodiment of circumferential portions having restricted guidance involves the circumferential portions being connected to at least one actuation element, in particular a push button, via at least one, preferably two guide elements, in particular guide pins, the guide elements being guided on a guide face, in particular slots, formed on the first coupling part.

In accordance with a further embodiment of the invention, pressing elements may be provided, which press the second coupling part against the contact face of the circumferential portions when the coupling parts are assembled with one another. As a result, disruptive relative micro-movements of the coupling parts, for example as a result of play of the coupling parts due to tolerances, can be effectively prevented, in that contact of the second coupling part with the contact face of the circumferential portions of the first coupling part is provided permanently by means of the pressing elements.

The pressing elements may be formed so as to be movable against the force of a spring element. As a result, the contact force of a pressing element is substantially produced by the force of the spring element.

Preferably, the pressing elements are formed by a plurality of balls, which are arranged distributed over the circumference of the first coupling part and which are held in recesses on the circumference of the first coupling part. As a result, the pressing elements are provided by a simple method of production.

It is possible for the second coupling part to comprise recesses, for example in the manner of depressions, in which the pressing elements, in particular balls, engage when the two coupling parts are moved correspondingly relative to one another into the necessary position for this purpose.

Preferably, the pressing elements act on the second coupling part in the radial direction by means of a contact force, for example the force of a spring element. As a result, the two coupling parts are held relative to one another in the radial direction, substantially without any freedom of movement, in such a way that the resulting disruptive micro-movements of the coupling parts relative to one another are prevented in spite of the relative play between the coupling parts due to tolerances.

In accordance with a further embodiment of the invention, it is provided that the circumferential portions comprise a thread, in particular an external thread, for screwing to the second coupling part, in such a way that the first coupling part can be brought into a screwed connection relative to the second coupling part by rotating about the axis. As a result, expander heads, of which the coupling part is provided with a thread and is used for screwing on the expander head, can also be coupled to the coupling part or first coupling part.

The first coupling part according to an embodiment of the invention is thus formed so as to make it possible to couple a second coupling part in two ways. On the one hand, a second coupling part which acts on the contact faces of the radially outwardly projecting circumferential portions can be coupled to the coupling part according to an embodiment of the invention. On the other hand, a second coupling part which engages in the thread, in particular external thread, can be coupled to the coupling part according to an embodiment of the invention.

The thread of the respective circumferential portions preferably extends with the same radial spacing in each case.

The thread of the respective circumferential portion preferably lies on a shared outer circumference, which is concentric with the axis, in particular central axis, along which the expanding mandrel can be moved so as to actuate the expander head. The thread is thus formed on the first coupling part concentrically with respect to the axis.

In accordance with a further embodiment of the invention, a coupling part for a coupling for connecting a driving device to an expander head, which is used to expand pipes and hoses and which is actuated by means of an expanding mandrel driven by the driving device, is a second coupling part which is or can be associated with the expander head and can be connected to a first coupling part of the above-disclosed type, which is or can be associated with the driving device, the coupling parts, when assembled with one another, being arranged along an axis along which the expanding mandrel can be moved so as to actuate the expander head.

According to an embodiment of the invention, the second coupling part comprises at least one, preferably a plurality of counter-portions, which engage from behind with radially outwardly projecting circumferential portions of the first coupling part and act on the respective contact face of the circumferential portions when the coupling parts are assembled with one another.

As a result of this measure, a coupling part is proposed which can be fixed, as a second coupling part, to a first coupling part of the above-disclosed type, and for this purpose makes use of the radially outwardly projecting outer circumferential portions of the first coupling part so as to form a positive connection. Thus, by way of the second coupling part according to an embodiment of the invention, it is possible to fix an expander head to a driving device of an expander device, together with the first coupling part, rapidly, without great use of force and with simple handling, in that the two coupling parts are interconnected without a screw connection.

It is possible for the counter-portions to be dimensioned circumferentially in such a way that when the coupling parts move axially relative to one another, the circumferential portions of the first coupling part and the counter-portions of the second coupling part engage in one another. As a result, it is possible to bring the two coupling parts together in a simple manner by axially displacing the coupling parts relative to one another, in such a way that after the coupling parts have engaged in one another, by rotating the second coupling part relative to the second coupling part an axially acting positive fit can be achieved, in which the counter-portions of the second coupling part act on the contact surfaces of the circumferential portions of the first coupling part.

Preferably, the counter-portions should correspond circumferentially to the respective gap between mutually adjacent circumferential portions of the first coupling part. In that the counter-portions substantially correspond in each case to the gap between mutually adjacent circumferential portions of the first coupling part, the largest possible overlap of the respective circumferential portion and the associated counter-portion is achieved for the counter-portions, arranged distributed over the circumference on the second coupling part, and the circumferential portions, on the first coupling part, and an axially acting positive fit connection for transferring large forces is thus produced.

Preferably, at least three counter-portions, which are distributed equidistantly around the circumference of the second coupling part, should be provided for this purpose.

In accordance with one embodiment of the invention, it is provided that the counter-portions form a circumferential rim, which extends in the radial direction, of the second coupling part. The second coupling part, along with the counter-portions thereof, can thus be produced in a technically simple manner, since in the course of the production thereof, for example by machining, the counter-portions merely have to be carved out from the rim of the second coupling part. The empty spaces which are to be formed between the counter-portions, which interrupt the rim in each case, may also be formed in this manner, for example.

In accordance with an alternative embodiment of the invention, it may be provided that the counter-portions form a circumferentially continuous rim, which extends in the radial direction, of the second coupling part. The counter-portions thus form a rim without interruptions or portion-free empty spaces. An embodiment of this type is possible in particular if the first coupling part comprises movable circumferential portions. As a result, the second coupling part is fixed to the first coupling part, with an axially acting positive fit connection, simply in that the two coupling parts are moved relative to one another in the axial direction, and the movable circumferential portions of the first coupling part are thus moved out of the engagement position thereof. Only after the two coupling parts have been brought together is an axially acting positive fit connection produced, in that the circumferential portions of the first coupling part are subsequently moved back into the engagement position with respect to the circumferential rim of the second coupling part.

In this embodiment of the invention, it is possible for the rim, formed by the counter-portions, of the second coupling part, to comprise an entry ramp on the inner circumference thereof, against which the movable circumferential portions of the first coupling part can be brought into the engagement position by sliding along in the axial direction when the coupling parts are joined. This makes it much easier to produce the engagement between the counter-portions of the second coupling part and the circumferential portions of the first coupling part, since the movable circumferential portions are automatically moved out of the engagement position by the entry ramp when the two coupling parts are jointed together axially. After passing the entry ramp, the movable circumferential portions subsequently move back into the engagement position automatically, for example under the force of at least one spring element, in such a way that the axially acting positive fit connection between the two coupling parts is produced.

In accordance with a further embodiment, the invention provides a coupling for connecting a driving device to an expander head, which is used to expand pipes and hoses and which is actuated by means of an expanding mandrel driven by the driving device, the coupling comprising a first coupling part of the above-disclosed type and a second coupling part of the above-disclosed type.

The invention, in an embodiment, also comprises a coupling for connecting a driving device to an expander head, which is used to expand pipes and hoses and which is actuated by means of an expanding mandrel driven by the driving device, comprising a first coupling part of the above-disclosed type and a second coupling part which has a thread corresponding to the thread of the first coupling part, in such a way that the second coupling part and the first coupling part can be interconnected by screwing.

In this context, it is preferred to associate the first coupling part with the driving device and the second coupling part with the expander head.

The invention further provides, in an embodiment, a driving device for an expander device for expanding pipes and hoses, comprising a coupling part of the above-disclosed type, in particular a first coupling part of the above-disclosed type.

In accordance with a development of the driving device, an adjustment device can be provided, by means of which the coupling part, in particular the first coupling part, can be moved in the axial direction relative to the expanding mandrel of the driving device in relation to the initial position thereof. By way of the adjustment device, the axial alignment of the coupling part can thus be adjusted relative to the expanding mandrel in relation to the initial position thereof, in such a way that the degree of expansion which can thus be achieved with an expander head fixed to the driving device can be altered, with fine tuning, by way of the adjustment device. In this context, the initial position may be the position of the expanding mandrel when retracted, in which the expanding mandrel does not act on the expander head.

An embodiment comprising an adjustment device is possible in particular for application purposes where copper pipes are being expanded.

By way of the adjustment device, there is the possibility of fine-tuning the desired degree of expansion and thus counteracting any tolerances. The resulting clearance between the expanded pipe and the introduced non-expanded pipe can thus be adjusted in a targeted manner, for example so as to produce an exact clearance for a soldering gap.

The invention further comprises, in an embodiment, an expander head for an expander device for expanding pipes and hoses, comprising a coupling part of the above-disclosed type, in particular a second coupling part of the above-disclosed type.

The invention further comprises, in an embodiment, an expander device for expanding pipes and hoses, comprising one of the above-disclosed couplings.

FIG. 1 is a schematic drawing of one possible embodiment of an expander device 100 for expanding pipes and hoses. The expander device 100 comprises a driving device 1 and an expander head 6, the expander head 6 being used to expand pipes and hoses and being actuated by means of an expanding mandrel 5 driven by the driving device 1.

In FIG. 1, for clearer understanding, the expander head 6 and the driving device 1 are shown in an exploded view with respect to one another, the expander head 6 being shown at a distance from the driving device 1, in such a way that the expanding mandrel 5 is made visible. When the expander head 6 and the driving device 1 are assembled together, the expanding mandrel 5 is not visible from the outside.

For fixing the expander head 6 to the driving device 1, the driving device 1 comprises a coupling part, which is referred to in the following as the first coupling part 20*a*. The expander head 6 comprises a coupling part which can be connected to the first coupling part 20*a* and which is referred to in the following as the second coupling part 60*a*.

In accordance with the embodiment of the driving device 1 according to FIG. 1, the first coupling part 20*a* is arranged on the housing 4 of the driving device 1, in particular held in place thereon, in particular formed integrally thereon.

The second coupling part 60*a* of the embodiment of the expander head 6*a* according to FIG. 1 is formed by a guide cap of the expander head 6, on which the expanding jaws 7 are movably held.

The first coupling part 20*a* and the second coupling part 60*a*, when assembled with one another, that is to say when the expander head 6 is mounted on the driving device 1, are arranged along an axis A along which the expanding mandrel 5 can be moved so as to actuate the expander head 6.

The axis A is preferably the central longitudinal axis of the expanding mandrel 5. Of course, it may also be provided that the axis A is an axis at a distance from and substantially parallel to the central longitudinal axis of the expanding mandrel 5.

The driving device 1 can be actuated manually, as can be seen from FIG. 1. For this purpose, the driving device 1 is preferably formed in a tong-like manner, and comprises two hand levers 2, 3, which can be moved relative to one another and which are mounted pivotably with respect to one another in a housing 4 of the driving device 1. By pivoting the hand levers 2, 3 towards one another, the expanding mandrel 5 is moved in the axial direction from an initial position along the axis A, preferably in a translational manner, towards an end position, the expanding mandrel 5, during the movement thereof, pressing expanding jaws 7 of the expander 6 radially outwards.

As an alternative to the manually actuated driving device 1, it is of course also possible to use a driving device which is actuated by an electric motor, pneumatically, and/or hydraulically so as to actuate an expander head, of the same type as the expander head 6 according to FIG. 1, by means of the expanding mandrel 5.

Figures 2, 3:
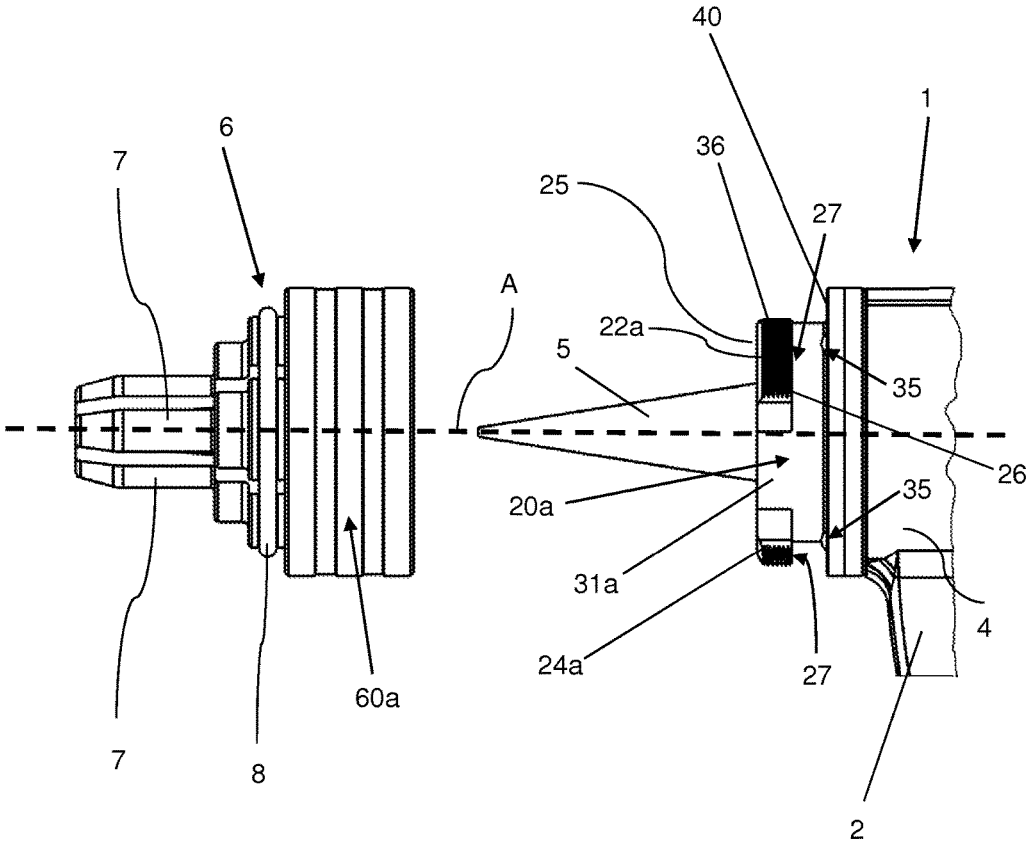
FIG. 2 is a side view of the expander head of the expander device according to FIG. 1.
FIG. 3 is a side view of a detail of the driving device of the expander device according to FIG. 1, in the fixing region for an expander head.
Figure 5:
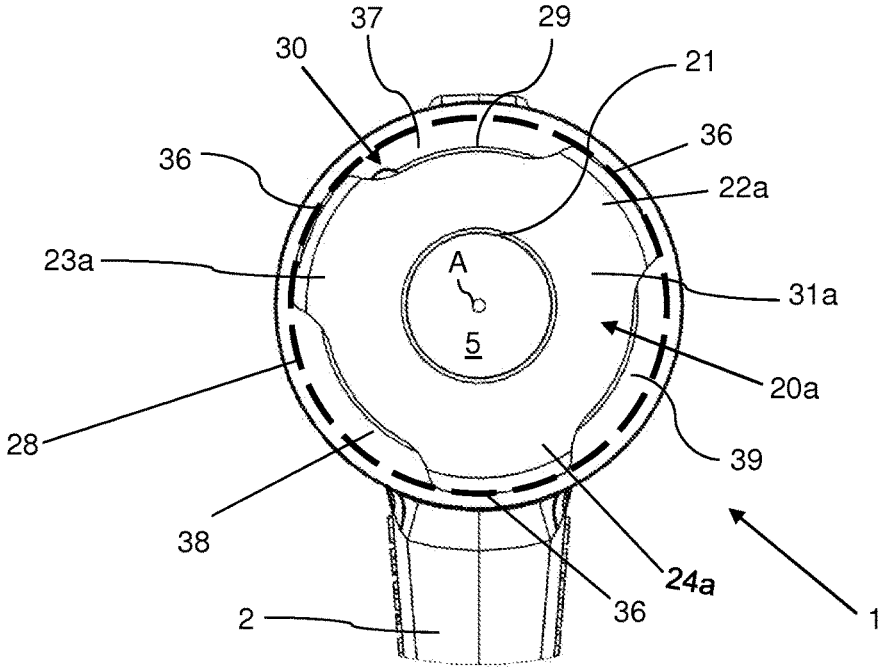
FIG. 5 shows the driving device according to FIG. 3 in a view towards the front face of the coupling part thereof for fixing an expander head.

FIGS. 3 and 5 are a side view (FIG. 3) and a front view (FIG. 5) of the dashed region 12 according to FIG. 1 of the driving device 1.

Figure 6:
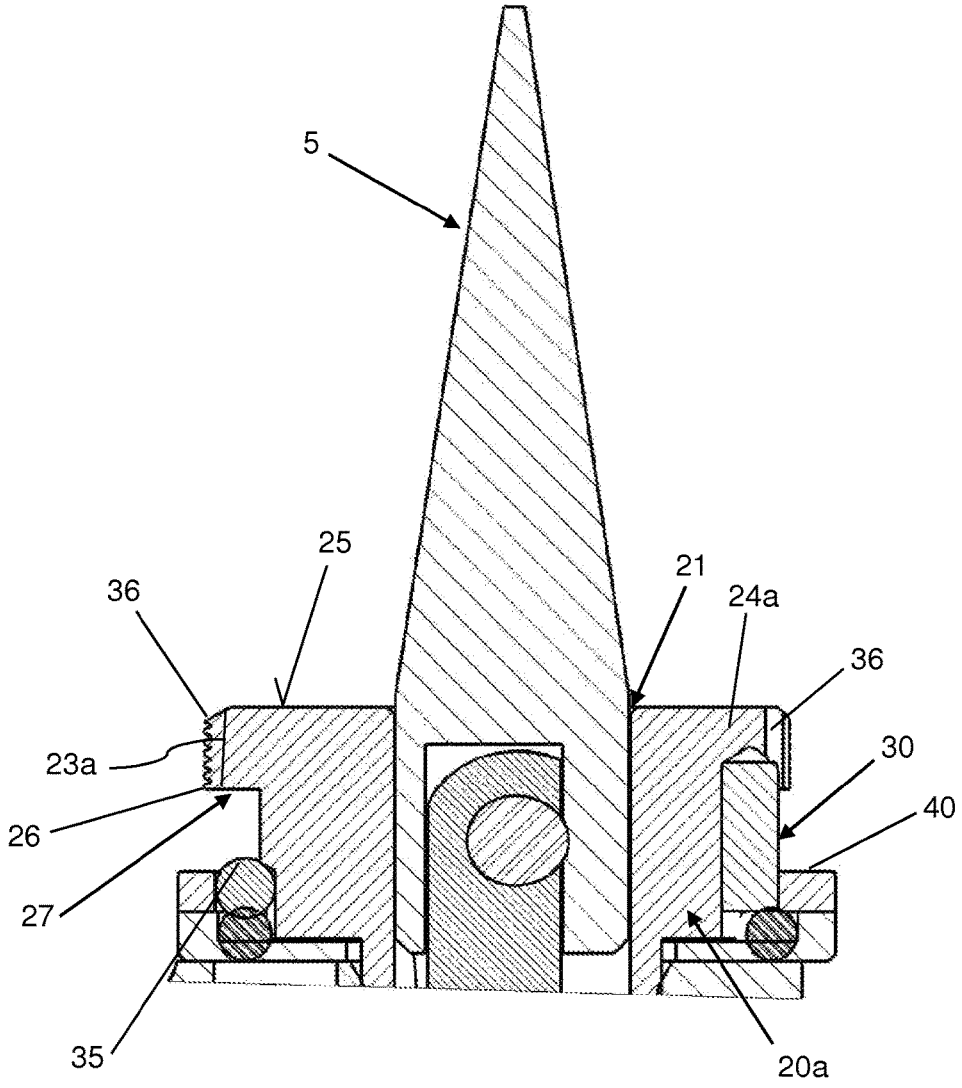
FIG. 6 is an axial section through the driving device in the region according to FIG. 3.

In addition, FIG. 6 is a longitudinal section of the dashed region 12 according to FIG. 1 of the driving device 1.

As can be seen in particular from FIGS. 3 and 5, the first coupling part 20*a* comprises a base body 31*a*, which is preferably cylindrical in form and the central axis of which is coincident with the axis A.

The radial dimensions of the base body 31*a* are smaller than those of the housing 4, which is attached to the base body 31*a* in the axial direction, of the driving device 1, in such a way that a circumferential shoulder 40 is formed as a stop between the base body 31*a* and the housing 4 in the axial direction, and is used as a stop for the second coupling part 60*a* of the expander head 6 during joining in the axial direction.

As can be seen in particular from FIGS. 5 and 6, the base body 31*a* comprises a preferably central through-hole 21, which is used as a passage for the expanding mandrel 5.

As can be seen from FIGS. 3, 5 and 6, on the first coupling part 20*a*, a plurality of, preferably 3, radially outwardly projecting circumferential portions 22*a*, 23*a*, 24*a* are provided on the circumference 29 of the base body 31*a*, and are preferably formed integrally with the base body 31*a*.

The radially outwardly projecting circumferential portions 22*a*, 23*a* and 24*a* each comprise a contact face 27 on the rear face 26 thereof, which the second coupling part 60*a* can counteract and engage with from behind, in such a way that, as a result of the second coupling part 60*a* being engaged with from behind, a positive fit connection in the axial direction is achieved between the two coupling parts 20*a* and 60*a*.

In this context, the rear face 26 or contact face 27 of the circumferential portions 22*a*, 23*a* and 24*a* is the side which is remote from the expander head 5 and preferably faces the housing 4, in particular the shoulder 40. The front face 25 of each circumferential portion 22*a*, 23*a*, 24*a* transitions into the end face of the base body 31*a*, as can be seen in particular from FIG. 5. The circumferential portions 22*a*, 23*a* and 24*a* are preferably formed integrally on the base body 31*a*. Further, the circumferential portions 22*a*, 23*a* and 24*a* are preferably distributed equidistantly on the circumference 29 of the base body 31*a*.

As can be seen in particular from FIG. 5, the radial ends of the circumferential portions 22*a*, 23*a* and 24*a* lie on a substantially circle-like, in particular substantially circular outer circumference 28, which is indicated by a dashed line in FIG. 5.

As a result of the outer circumference 29 of the base body 31*a* also being substantially round, in particular circular, a respective gap 37, 38 and 39 is formed circumferentially between every two adjacent circumferential portions 22*a* and 23*a*, 23*a* and 24*a*, 24*a* and 22*a*, and said gaps are preferably positioned equidistantly as a result of the equidistant distribution of the circumferential portions 22*a*, 23*a* and 24*a* around the circumference 28 or 29.

Figure 4:
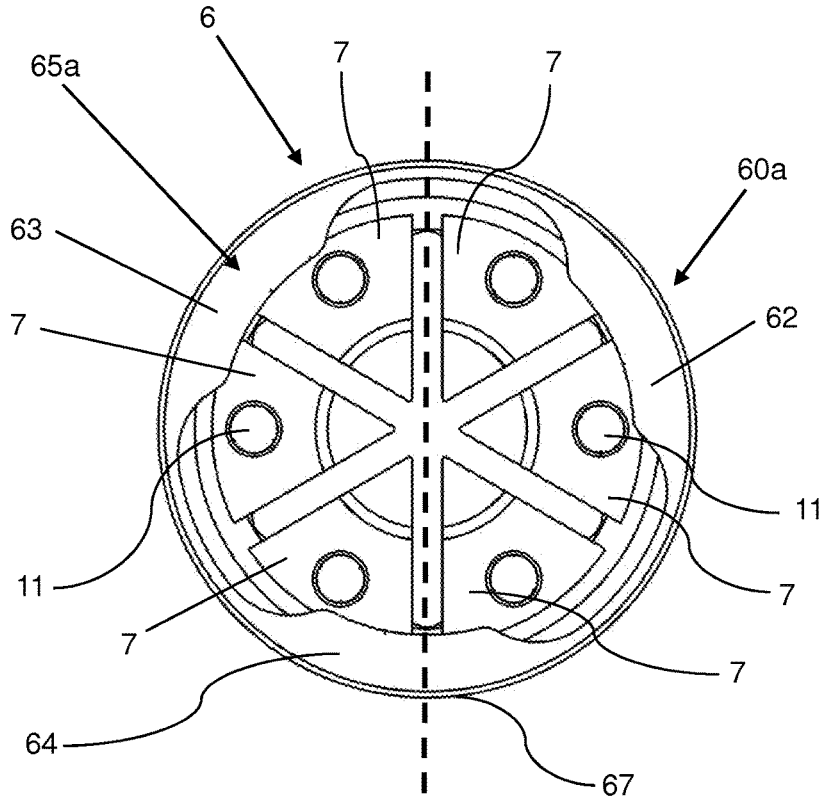
FIG. 4 shows the expander head according to FIG. 2 in a view towards the rear face, which is provided with a coupling part, of the expander head.

FIGS. 2 and 4 are a side view (FIG. 2) and a rear view (FIG. 4) of the expander head 6 of the expander device 100 according to FIG. 1, the rear view illustrating the axial end of the expander head 6 for fixing to the driving device 1.

As can be seen in particular from FIG. 4, the second coupling part 60*a*, which is arranged on the expander head 6, is provided with counter-portions 62, 63 and 64, which, when the second coupling part 60*a* and the first coupling part 20*a* are assembled with one another, engage with the radially outwardly projecting circumferential portions 22*a*, 23*a*, 24*a* of the first coupling part 20*a* from behind and act on the respective contact face 27 of the circumferential portions 22*a*, 23*a* and 24*a*.

In this context, the counter-portions 60, 63, 64 of the second coupling part 60*a* are circumferentially dimensioned in such a way that, when the coupling parts 60*a* and 22*a* move axially relative to one another, the circumferential portions 22*a*, 23*a* and 24*a* of the first coupling part 20*a* and the counter-portions 62, 63, 64 of the second coupling part 60*a* engage in one another. In this context, the counter-portions 62, 63, 64 are preferably dimensioned circumferentially in a manner substantially corresponding to the gaps 37, 38 and 39 of the first coupling part 20*a*.

As can be seen from FIG. 4, for this purpose the counter-portions 62, 63 and 64 are preferably formed on the radial inner circumference thereof in such a way that the radially inner end lies on a shared inner circumference, which is substantially round, in particular substantially circular in form. The counter-portions 62, 63 and 64 are preferably distributed equidistantly on the circumference, a gap being formed in each case between respectively adjacent counter-portions 62 and 63, 63 and 64, and 64 and 62, and serving to receive a respective circumferential portion 22*a*, 23*a* and 24*a* of the first coupling part 20*a* when the coupling parts 60*a* and 20*a* move axially relative to one another.

In that the gaps 37, 38 and 39 substantially correspond circumferentially to the dimensions of the counter-portions 62, 63, 64, and the gaps between the counter-portions 62, 63 and 64 correspond to the dimensions of the circumferential portions 22*a*, 23*a* and 24*a* of the first coupling part 20*a*, on the one hand it is made possible for the coupling parts 60*a*, 20*a* to engage in one another when the coupling parts 60*a*, 20*a* move axially, and on the other hand, when the coupling parts 60*a*, 20*a* rotate through a predetermined angle relative to one another, an overlap between the circumferential portions 22*a*, 23*a* and 24*a* and the counter-portions 62, 63, 64 with the largest possible contact face is achieved, in such a way that an axially acting positive fit connection is formed, which can transfer particularly large axial forces. By way of the connection, a connection in the radial direction is further produced, in such a way that when the second coupling part 60*a* is assembled on the first coupling part 20*a* the expander head 6 is fixed to the driving device 1 in a positive fit.

The second coupling part 60*a* preferably comprises a hollow cylindrical base body 67, which is arranged concentric with the axis A and which is preferably in the form of a sleeve or a similar hollow body.

In this context, the counter-portions 62, 63, 64 form a rim 65*a*, which extends in the radial direction, of the base body 67. The rim 65*a* is preferably circumferential and interrupted by the gaps between the counter-portions 62, 63 and 64.

A stop 30 is provided so as to ensure that, after the second coupling part 60*a* is brought together axially with the first coupling part 20*a*, the two coupling parts 60*a*, 20*a* are only rotated far enough with respect to one another that the counter-portions 62, 63, 64 of the second coupling part 60*a* counteract the contact faces 27 of the circumferential portions 22*a*, 23*a* and 24*a* of the first coupling part 20*a* with the largest possible overlap, and thus produce the positive fit connection in the axial direction.

The stop 30 is preferably associated with the first coupling part 20*a*, as can be seen from FIGS. 5 and 6. By way of the stop 30, the coupling movement of the first coupling part 20*a* is delimited relative to the second coupling part 60*a*.

The stop 30 preferably also delimits the decoupling movement of the two coupling parts 20*a*, 60*a* out of the positive fit connection. For this purpose, the stop 30 is preferably in the form of a pin element, and the longitudinal axis thereof is arranged in the direction of the axis A on the circumference 29 of the base body 31*a*. The stop 30 is thus positioned circumferentially close to one of the circumferential portions 22*a*, 23*a* or 24*a*, in such a way that the two coupling parts 20*a* and 60*a* are coupled with one another when the stop 30 is reached if the rotational movement of the two coupling parts 20*a* and 60*a* relative to one another is carried out in one direction. Further, when the stop 30 is reached by rotating the coupling parts 20*a* and 60*a* relative to one another in the opposite direction, the decoupled state is reached as regards the axially acting positive fit connection.

As can be seen in particular from FIGS. 3 and 6, pressing elements 35 may be provided, which are preferably arranged on the second coupling part 20*a*. By way of the pressing elements 35, when the coupling parts 20*a*, 60*a* are assembled with one another, the second coupling part 60*a* is pressed against the contact face 27 of the circumferential portions 22*a*, 23*a*, 24*a* of the first coupling part 20*a*.

As can be seen in particular from FIG. 6, the pressing elements 35 may be formed by a plurality of spherical elements, which are arranged distributed over the circumference and which are formed in recesses on the shoulder 40 or the circumferential face formed by the shoulder 40. So as to produce the contact force, the spherical elements are preferably connected to a spring element, which is supported for example against the housing 4 of the driving device 1.

Figure 7:
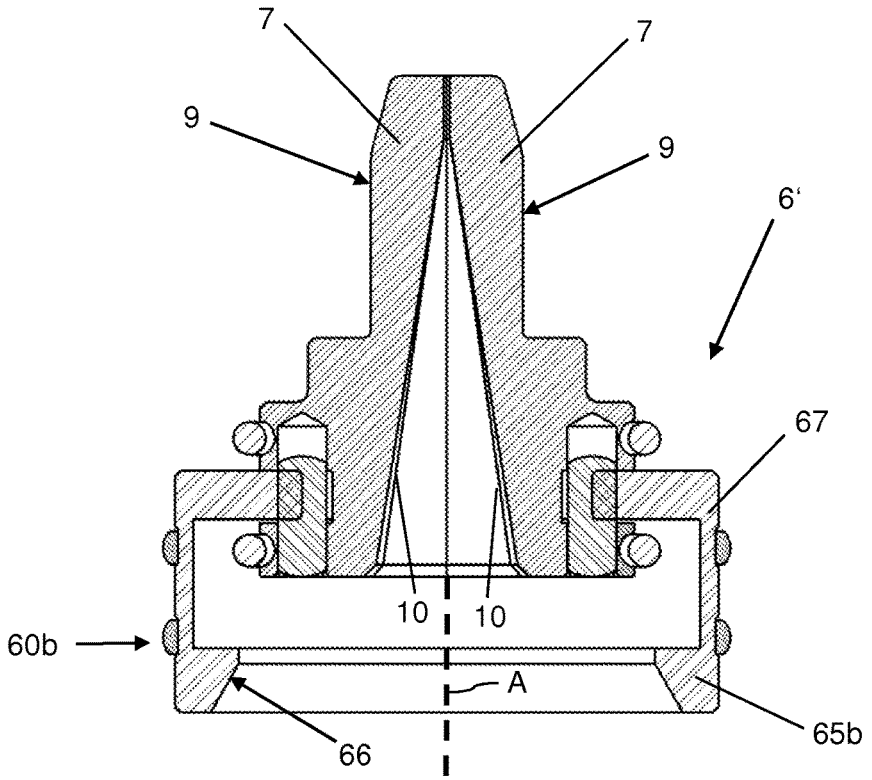
FIG. 7 is an axial section through a further possible embodiment of an expander head.
Figure 8:
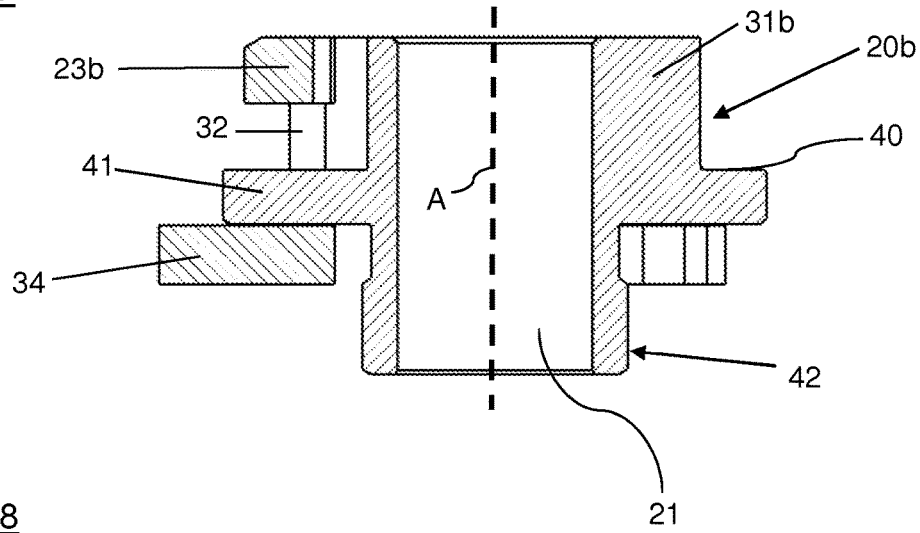
FIG. 8 is a sectional view of one possible embodiment of a coupling part, which can be attached to a driving device, for fixing the expander head according to FIG. 7.
Figure 9:
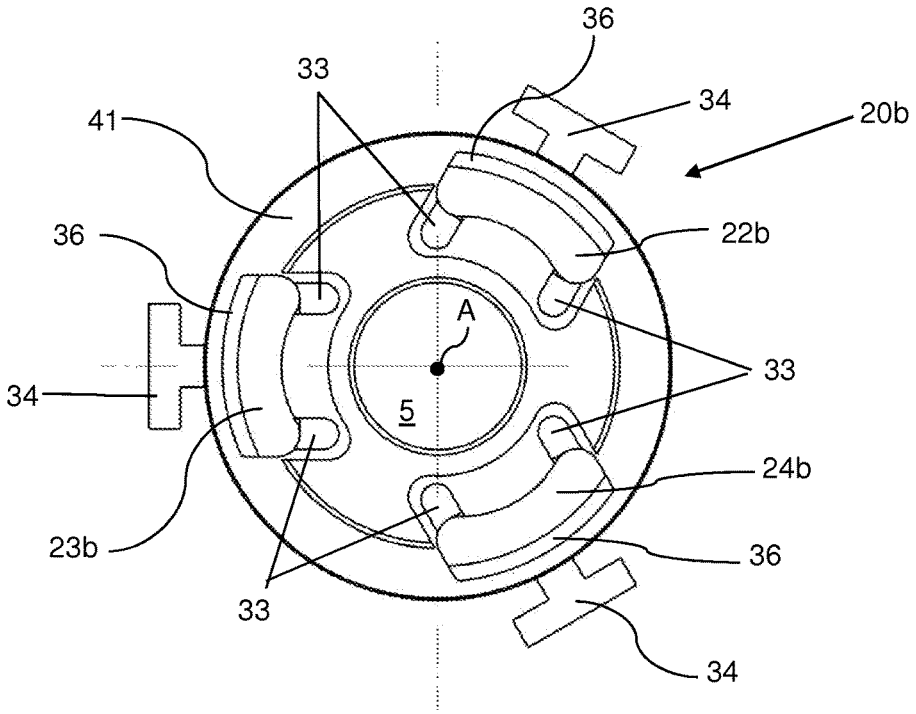
FIG. 9 shows the coupling part according to FIG. 8 in a view towards the front face thereof, to which the expander head according to FIG. 7 can be fixed.

FIGS. 7, 8 and 9 show a further possible embodiment of a coupling, comprising a first coupling part 20*b* and a second coupling part 60*b*, the first coupling part 20*b* being associated or being able to be associated with a driving device, and the second coupling part 60*b* being associated or being able to be associated with an expander head 6'. FIG. 7 shows the expander head 6' together with the second coupling part 60*b*, and FIGS. 8 and 9 show the first coupling part 20*b*.

Components or functional portions of the expander head 6' and the coupling parts 20, 60*b* according to FIGS. 7 to 9 which are identical or functionally equivalent to components or functional portions of the expander head 6 and the coupling parts 20*a*, 60*a* are provided with like reference numerals; in this connection, reference is made to the description of FIGS. 1 to 6.

As can be seen in particular from FIGS. 8 and 9, the first coupling part 20*b* differs from the first coupling part 20*a* according to FIGS. 1, 3, 5 and 6 in that, among other things, the first coupling part 20*b* comprises circumferential portions 22*b*, 23*b* and 24*b* which can be moved out of an engagement position with respect to the second coupling part 60*b*.

As can be seen in particular from FIG. 9, for this purpose the circumferential portions 22*b*, 23*b*, 24*b* may each be connected to an actuation element 34, in particular a push button, in each case via at least two guide elements 32, in particular guide pins, the guide elements 32 being guided on a guide face, in particular slots 33, formed on the first coupling part 20*b*. By means of the guide elements 32, the circumferential portions 22*b*, 23*b*, 24*b* can each be moved radially inwards, in particular displaced in a translational manner, by actuating the associated actuation element 34 counter to the restoring force of at least one spring element. After the actuation element 34 is released, the circumferential portions 22*b*, 23*b*, 24*b* each automatically move back into the engagement position, in which the positive fit connection in the axial direction is subsequently produced between the coupling parts 20*a* and 60*b*.

The actuation elements 34 may for example be arranged, as seen in the direction of the axis A, outside the engagement region of the second coupling part 60*b*, which is delimited from the driving device or the housing thereof by for example a circumferentially outwardly projecting projection 41.

As can further be seen from FIG. 9, the first coupling part 20*b* may also be arranged releasably on the driving device, for example in that the first coupling part 20*b* is to be screwed to the driving device or the housing thereof by means of a thread 42 on the first coupling part 20*b*. For this purpose, the thread 42 is preferably formed on the base body 31*b* of the first coupling part 20*b*, in particular on a free end, which can be introduced into a recess of the driving device, of the base body 31*b*.

Just like the circumferential portions 22*a*, 23*a*, 24*a* of the first coupling part 20*a* according to FIGS. 3, 5 and 6, the circumferential portions 22*b*, 23*b* and 24*b* of the first coupling part 20*b* according to FIGS. 8 and 9 preferably comprise an external thread 36, in such a way that an expander head having a screw-on coupling part can be fixed thereon. The internal thread of this coupling part subsequently engages in the thread 36 of the circumferential portions 22*b*, 23*b* and 24*b* or 22*a*, 23*a*, 24*a*.

FIG. 7 shows the expander head 6' along with the second coupling part 60*b*, which is suitable for coupling to the first coupling part 20*b* according to FIGS. 8 and 9.

A radially extending rim 65*b* is formed on the base body 67 of the second coupling part 60*b*, at the end as seen in the axial direction, and is circumferential, preferably continuously circumferential. For coupling the expander head 6' according to FIG. 7, the expander head 6' should be guided towards the first coupling part 20*b* in the axial direction, the circumferential portions 22*b*, 23*b* and 24*b* each being displaced radially inwards by the actuation elements 34 until the end face of the second coupling part 60*b* can be moved into contact with the shoulder 40 of the first coupling part 20*b*. After the actuation elements 34 are released, the circumferential portions 22*b*, 23*b*, 24*b* are automatically moved back radially outwards into the engagement position by the force of the at least one spring element, resulting in the circumferential rim 65*b* of the second coupling part 60*b* coming into contact with the contact face 27 of the circumferential portions 22*b*, 23*b* and 24*b*.

As can further be seen from FIG. 7, the rim 65*b* comprises on the inner circumference thereof an entry ramp 66, against which the movable circumferential portions 22*b*, 23*b* and 24*b* of the first coupling part 20*b* can be brought into the engagement position by sliding along in the axial direction when the coupling parts 20*b*, 60*b* are joined. As a result, it is easier or virtually no longer necessary to actuate the actuation elements 34.

The construction of the expander head 6' can further be seen from FIG. 7. Accordingly, the plurality of expanding jaws 7 which are arranged distributed around the axis A are each provided on the outer circumferential face thereof with an expander face 9, which acts against the inner circumference of the pipe portion which is slid onto the expanding jaws 7.

The expanding jaws 7 each comprise, on the inner circumferential side, a control face 10, which enters an operative connection with the outer circumferential face of the expanding mandrel 5 when the driving device 1 is actuated so as to produce the expansion of the expanding jaws 7 in the radial direction. The expanding jaws 7 are further enclosed at the guide flanges thereof by an extension spring 8, the expanding jaws 7 being held on the base body 67 by means of guide pins 11.

Figure 10:
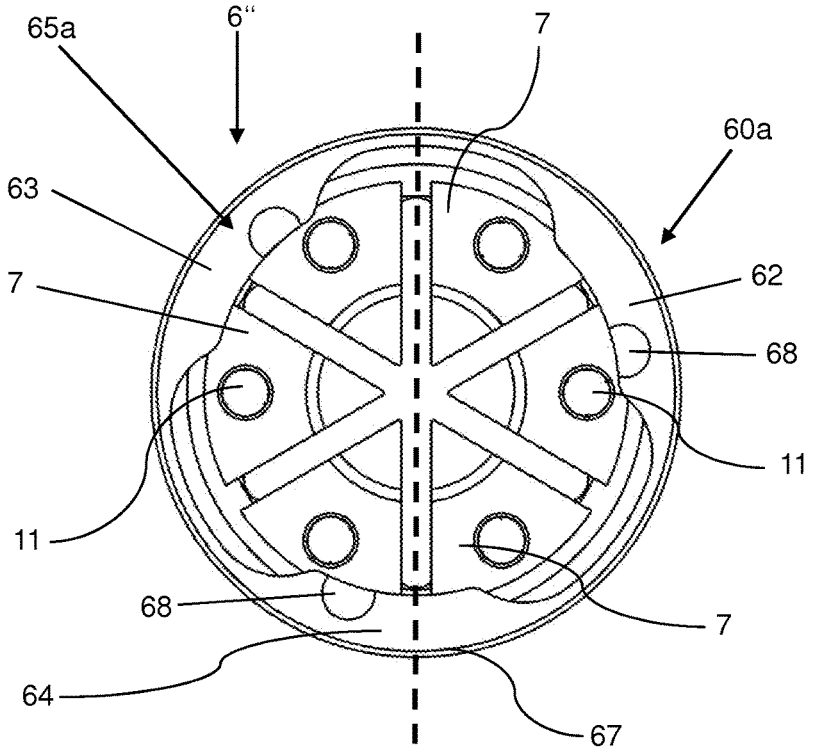
FIG. 10 shows a further possible embodiment of an expander head, in a view towards the rear face, which is provided with a coupling part, of the expander head

FIG. 10 shows a further possible embodiment of an expander head 6", which is suitable for fixing to the driving device 1 according to FIGS. 3 and 5. The expander head 6" according to FIG. 10 differs from the expander head 6 according to FIGS. 2 and 4 in that, among other things, at least one recess 68 is provided on the outer end face of each of the counter-portions 62, 63 and 64. The respectively associated pressing elements 35 latches into each recess when the two coupling parts 20*a*, 60*a* are brought towards one another into a positive fit connection in the axial direction. The recesses 68 are preferably in the form of a spherical portion so as to be able to receive a pressing elements in the manner of a sphere.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE NUMERALS

1 driving device
2 hand lever
3 hand lever
4 housing
5 expanding mandrel
6 expander head
6' expander head
6" expander head
7 expanding jaws
8 extension spring
9 expander face
10 control face
11 guide pin
12 dashed region
20*a* first coupling part
20*b* first coupling part
21 through-hole
22*a* circumferential portion
22*b* circumferential portion
23*a* circumferential portion
23*b* circumferential portion
24*a* circumferential portion
24*b* circumferential portion
25 front face
26 rear face
27 contact face
28 outer circumference
29 circumference
30 stop
31*a* base body
31*b* base body

32 guide element
33 slot
34 actuation element
35 pressing elements
36 thread
37 gap
38 gap
39 gap
40 shoulder
41 projection
42 thread
60*a* second coupling part
60*b* second coupling part
62 counter-portion
63 counter-portion
64 counter-portion
65*a* edge
65*b* edge
66 entry ramp
67 base body
68 recess
100 expander device
A axis

The invention claimed is:

1. A driving device for an expander device for expanding pipes and hoses, comprising:

a first coupling part for a coupling which is configured to connect the driving device to an expander head by means of a second coupling part which is associated with the expander head, wherein the expander head is used to expand pipes and hoses and is actuated by means of an expanding mandrel driven by the driving device, wherein the coupling parts, when assembled with one another, are arranged along an axis along which the expanding mandrel can be moved so as to actuate the expander head, the first coupling part comprising:

i) a through-hole extending in a direction of the axis as a passage for the expanding mandrel;

ii) radially outwardly projecting circumferential portions disposed along first portions of an inner circumference of the first coupling part to an outer circumference of the first coupling part, a rear face of the circumferential portions including a contact face configured to engage with the second coupling part from behind;

iii) gaps disposed along second portions of the inner circumference of the first coupling part and separating the radially outwardly projecting circumferential portions;

iv) at least one stop configured to delimit, in a circumferential direction, at least one of a coupling movement and an uncoupling movement of the first coupling part of the driving device relative to the second coupling part of the expander head;

wherein the first coupling part is configured to be connected to a second coupling part of another expander head via a thread of the circumferential portions being brought into a screw connection of the second coupling part of the other expander head by rotation about the axis;

and wherein, in radial direction, the at least one stop protrudes over the inner circumference of the first coupling part and is spaced apart from the thread.

2. The driving device according to claim 1, wherein radial ends of the circumferential portions lie at the outer circumference, the outer circumference having a contour substantially corresponding to a contour of the inner circumference of the first coupling part.

3. The driving device according to claim 1, wherein the at least one stop is a pin.

4. The driving device according to claim 1, wherein the circumferential portions are immovable relative to the first coupling part.

5. The driving device according to claim 1, wherein the circumferential portions are held movably on the first coupling part and are movable out of an engagement position with respect to the second coupling part.

6. The driving device according to claim 5, wherein the circumferential portions are movable out of the engagement position with respect to the second coupling part against a restoring force of at least one spring element.

7. The driving device according to claim 1, further comprising pressing elements configured to press the second coupling part against the contact face of the circumferential portions in the assembled state of the coupling parts.

8. An expander device for expanding pipes and hoses, comprising:

a first coupling part comprising:

i) a through-hole extending in a direction of the axis as a passage for the expanding mandrel;

ii) radially outwardly projecting circumferential portions disposed along first portions of an inner circumference of the first coupling part to an outer circumference of the first coupling part, iii) a rear face of the circumferential portions including a contact face configured to engage with the second coupling part from behind;

iv) a plurality of gaps disposed along second portions of the inner circumference of the first coupling part and separating the radially outwardly projecting circumferential portions;

a second coupling part comprising:

radially inwardly projecting counter portions which engage from behind with the radially outwardly projecting circumferential portions of the first coupling part and having counter contact faces which act on the respective contact face of the radially outwardly projecting circumferential portions, radially inwardly projecting counter portions disposed along first portions of an outer circumference of the second coupling part and extending radially inwardly to an inner circumference of the second first coupling part, gaps disposed along second portions of the outer circumference of the second coupling part and separating the radially inwardly projecting counter portions, wherein each of the radially outwardly projecting circumferential portions are curved inward from the outer circumference to the inner circumference at both circumferential ends and wherein each of the radially inwardly projecting counter portions are curved outward from the inner circumference to the outer circumference at both circumferential ends.

9. The expander device according to claim 8, wherein each of the three counter-portions is dimensioned circumferentially so as to engage with at least one of the three circumferential portions upon the coupling parts moving axially relative to one another.

10. The expander device according to claim 8, wherein each of the three counter-portions corresponds circumferentially to at least one respective gap disposed between mutually adjacent circumferential portions of the first coupling part.

11. The expander device according to claim 8, wherein each of the three counter-portions forms a circumferential rim that extends in a radial direction of the second coupling part.

12. An expander device configured to expand pipes and hoses comprising:

a driving device comprising:

a first coupling part;

an expanding mandrel coupled to the driving device;

an expander head, wherein the expander head is used to expand pipes and hoses and is actuated by means of said expanding mandrel driven by the driving device, and the expander head having a second coupling part which is configured to be coupled to said first coupling part and arranged along an axis along which the expanding mandrel can be moved so as to actuate the expander head, the first coupling part comprising:

a through-hole extending in a direction of the axis as a passage for the expanding mandrel;

radially outwardly projecting circumferential portions disposed along first portions of an inner circumference of the first coupling part to an outer circumference of the first coupling part, a rear face of the circumferential portions including a contact face for the second coupling part and wherein the contact faces of the circumferential portions lie in a same plane;

a plurality of gaps disposed along second portions of the inner circumference of the first coupling part and separating the radially outwardly projecting circumferential portions;

wherein the second coupling part comprising:

counter portions which engage from behind with the radially outwardly projecting circumferential portions of the first coupling part and having counter contact faces which act on the respective contact face of the radially outwardly projecting circumferential portions, wherein the counter contact faces of the counter portions lie in a same plane.

* * * * *